US007165368B2

(12) United States Patent
Knapp

(10) Patent No.: US 7,165,368 B2
(45) Date of Patent: Jan. 23, 2007

(54) INSULATION BLANKET WITH CUT GUIDELINES

(75) Inventor: Kenneth David Knapp, East Norriton, PA (US)

(73) Assignee: CertainTeed Corporation, Valley Forge, PA (US)

( * ) Notice: Subject to any disclaimer, the term of this patent is extended or adjusted under 35 U.S.C. 154(b) by 903 days.

(21) Appl. No.: 09/975,386

(22) Filed: Oct. 11, 2001

(65) Prior Publication Data

US 2003/0070378 A1 Apr. 17, 2003

(51) Int. Cl.
*E04D 3/35* (2006.01)

(52) U.S. Cl. ..... 52/449; 52/409; 52/443; 52/745.21; 52/745.19; 52/483.1; 52/475.1; 428/131; 428/143

(58) Field of Classification Search ..... 52/449, 52/446, 443, 444, 742.1, 742.13, 745.21, 52/746.1, 409; 428/43, 40, 131; 156/250, 156/252, 253
See application file for complete search history.

(56) References Cited

U.S. PATENT DOCUMENTS 649,363 A * 5/1900 Ryan ..... 52/446
911,223 A * 2/1909 Fishack ..... 52/449
RE14,148 E * 6/1916 Sexton ..... 52/446
1,536,932 A * 5/1925 Rolfe ..... 52/449
1,568,314 A * 1/1926 Buttress et al. ..... 52/449
1,586,018 A * 5/1926 Westberg ..... 52/449
1,902,872 A * 3/1933 Long ..... 52/449
1,917,062 A * 7/1933 Reinhard ..... 52/449
2,175,226 A * 10/1939 Slayter ..... 52/409
3,041,219 A * 6/1962 Steck ..... 428/138
3,111,787 A * 11/1963 Chamberlain ..... 52/309.9
3,126,978 A * 3/1964 Bergstrom ..... 181/290
3,770,560 A * 11/1973 Elder et al. ..... 428/138
3,835,604 A 9/1974 Hoffman
4,039,709 A * 8/1977 Newman ..... 428/159
4,235,303 A * 11/1980 Dhoore et al. ..... 181/214
4,313,524 A * 2/1982 Rose ..... 181/291
4,470,863 A * 9/1984 Brown et al. ..... 156/250
4,709,523 A * 12/1987 Broderick et al. ..... 52/506.05
4,784,891 A * 11/1988 Shickel ..... 428/137
4,902,550 A * 2/1990 Shickel ..... 428/137
5,164,238 A * 11/1992 Horiki et al. ..... 428/43
5,358,781 A * 10/1994 Sakai et al. ..... 442/378
6,128,879 A * 10/2000 Bussey et al. ..... 52/408
6,444,289 B1 * 9/2002 Ernest ..... 428/138

FOREIGN PATENT DOCUMENTS

JP 240841 * 8/1994 ..... 52/433
JP 99891 * 4/1995 ..... 428/159

* cited by examiner

*Primary Examiner*—Phi Dieu Tran A
(74) *Attorney, Agent, or Firm*—Paul & Paul

(57) ABSTRACT

A blanket of fibrous building insulation is provided, for in situ cutting to correspond to spacings between studs or like building members between which the insulation is to be applied. The blanket includes a layer of fibrous insulation material and a facing material adhered thereto. An adhesive provides the adhesion between the two layers. Perforations in the facing material provide openings allowing some of the adhesive to bleed into the perforations to be visible from the opposite side whereby a plurality of perforations provide guidelines for cutting the blanket to desired sizes for installation between structural building members.

9 Claims, 3 Drawing Sheets

INSULATION BLANKET WITH CUT GUIDELINES

BACKGROUND OF THE INVENTION

In the art of building insulation, it is known to provide a fibrous blanket, preferably of fiberglass construction, comprising a plurality of glass fibers, generally with a binder, of a given thickness, for insulating a building against heat, cold and the like. It is also known to provide such a blanket of insulation with a facing material and to secure the facing material to the fibrous layer by means of a suitable adhesive.

The blanket of faced insulation may then be applied between parallel vertical studs or the like, or between rafters or any other spaced-apart structural members. Typical of such an insulation blanket is that disclosed in U.S. Pat. No. 3,835,604, the complete disclosure of which is herein incorporated by reference.

It is also known to apply certain markings to the facing material that will facilitate cutting the insulation blanket to a given size at the site of insulation. The markings that are applied to the facing material are generally applied by running the facing material through a separate inking or printing step, so that the outside surface of the facing material will reveal cut lines to facilitate cutting the blanket to a desired pre-selected spacing between studs or the like.

The present invention is directed to providing cutting guidelines for faced building insulation, without using a separate inking, printing step or the like.

In accordance with the present invention, the adhesive that is applied to the facing material to secure the fibrous layer to the facing material provides a visual indication on the outer surface of the facing material, for the purposes of providing cutting guidelines. The way that this is done, is that the facing material is provided with pre-established perforations, preferably arranged in a grid. Then, when adhesive is applied to the surface of the facing material to which the fibrous layer is to be applied, the adhesive will bleed into the perforations such that it will be visible on the outside surface of the facing material, sufficient to establish a cutting line between the perforations, such that the blanket may be cut to size in situ to correspond with spacing between studs or the like that are non-standard.

Accordingly, it is a primary object of this invention to provide a novel blanket of fibrous building insulation for installation in openings between building structural members, including a fibrous insulation layer, a facing sheet, an adhesive layer securing the facing sheet and fibrous insulation layer together, and a grid of perforations through the facing sheet whereby spots of the adhesive that is applied to the facing sheet will be visible through those perforations on the opposite side of the facing sheet to which the adhesive is applied, to define generally straight, predetermined cut lines for cutting the facing sheet and insulation in accordance with a pattern defined by spots of adhesive, so that the blanket may be cut to size to accommodate irregular spaces between spaced-apart structural members.

It is a further object of this invention to provide a method of making a blanket of fibrous building insulation wherein the facing material is delivered to the site of blanket formation with the perforations already pre-applied to the facing material, such that the facing material may then have the adhesive applied to adhere the facing material to the insulation layer, whereby some of the adhesive will bleed through the perforations and be visible on an opposite face of the facing layer.

It is yet another object of this invention to provide a method of installing a blanket of fibrous building insulation, in which the blanket is made in accordance with the objects set forth immediately above, and wherein the blanket is cut along a line of perforations to correspond the width of the blanket to a pre-determined spacing of structural members between which the blanket is to be installed.

Other objects and advantages of the present invention will be readily apparent upon the reading of the following brief descriptions of the drawing figures, detailed descriptions of the preferred embodiments, and the appended claims.

BRIEF DESCRIPTIONS OF THE DRAWING FIGURES

Referring now to the drawings in detail, reference is first made to FIG. 1, wherein it will be seen that there is illustrated a fragmentary perspective view of a blanket of fibrous building insulation having a facing material on a surface thereof, with perforations arranged on a grid on the facing material, with adhesive being visible on the surface, through the perforations.

DETAILED DESCRIPTIONS OF THE PREFERRED EMBODIMENTS

Figure 1:
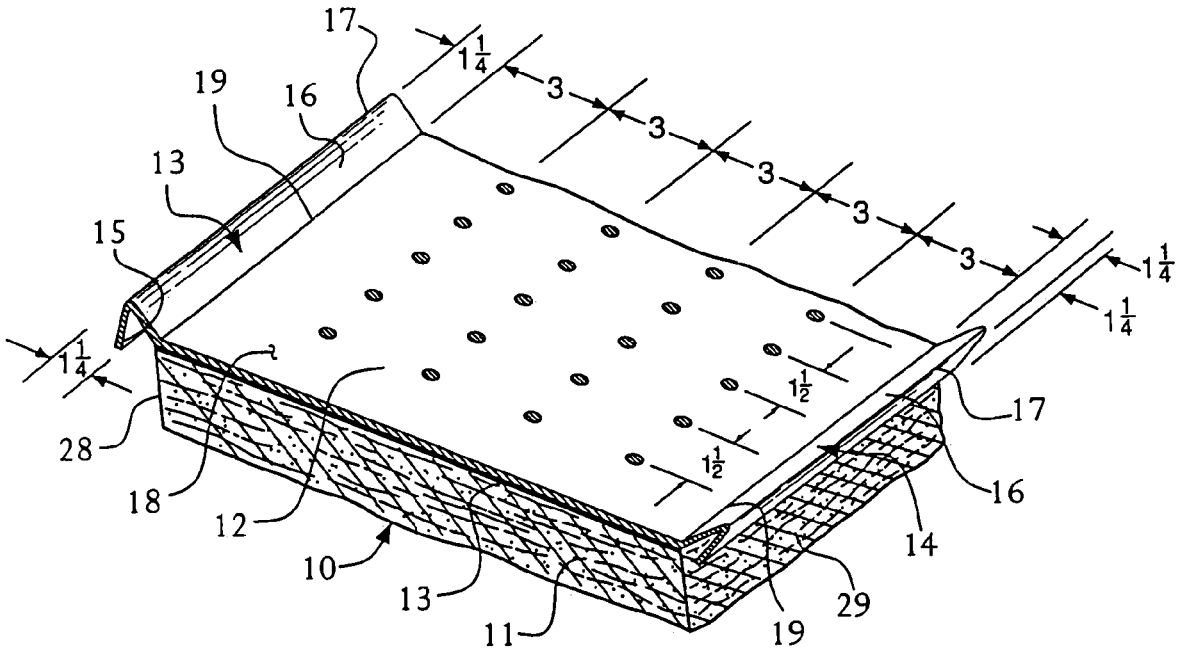

Referring now to the drawings in detail, reference will first be made to FIG. 1, wherein a blanket of fibrous building insulation is generally designated by the numeral 10, as comprising a fibrous insulation layer 11, of preferably fiberglass construction, having a conventional binder therein holding the glass fibers together, and wherein a facing material 12 is provided, which facing material 12 is much thinner than the substantially greater thickness of the insulation layer 11 as shown in FIG. 1. The facing material 12 will generally be in sheet or web form, and may be of paper, such as Kraft paper, or a paper having aluminum or other foil on a surface thereof. The facing material 12 and the fibrous layer 11 are adhered together by a suitable adhesive layer 13, also much thinner than the substantially greater thickness of the insulation layer 11 as shown in FIG. 1. The adhesive layer 13 will preferably be a bitumen, generally asphalt, and it secures the layers 11 and 12 together after it sets.

The facing material 12 is provided with fastener edges 13 and 14, each of which comprise portions 15 and 16, folded along fold lines 17. The fastener edges 13 and 14 do not generally have fibrous insulation applied thereto, so that they can be used to staple, nail, or otherwise secure the blanket 10 between studs, as can be seen in FIG. 3, which will be described hereinafter.

Visible on the surface 18 as shown in FIG. 1. of the facing material 12, is a grid of visible adhesives spots 20, arranged in horizontal and vertical lines. It will be seen that in the embodiment of FIG. 1, there are four vertical rows of spots 20, each 3 inches apart, with the outer rows also spaced 3 inches each from fold lines 19 adjacent side surfaces of insulation 28, 29. A typical spacing between horizontal lines of spots 20 would be 1½ inches, as shown in FIG. 1, such that a rectangular grid as shown in FIG. 1 is readily realized. It is typical that the spacing between conventionally spaced-apart vertical studs in a building is 16 inches, such that 15 inches of insulation fits well between such studs. It is also typical that each fastener edge 13, 14 is 2½ inches, folded in half to allow 1¼ inches on each side of the fold lines 17.

Figure 2:
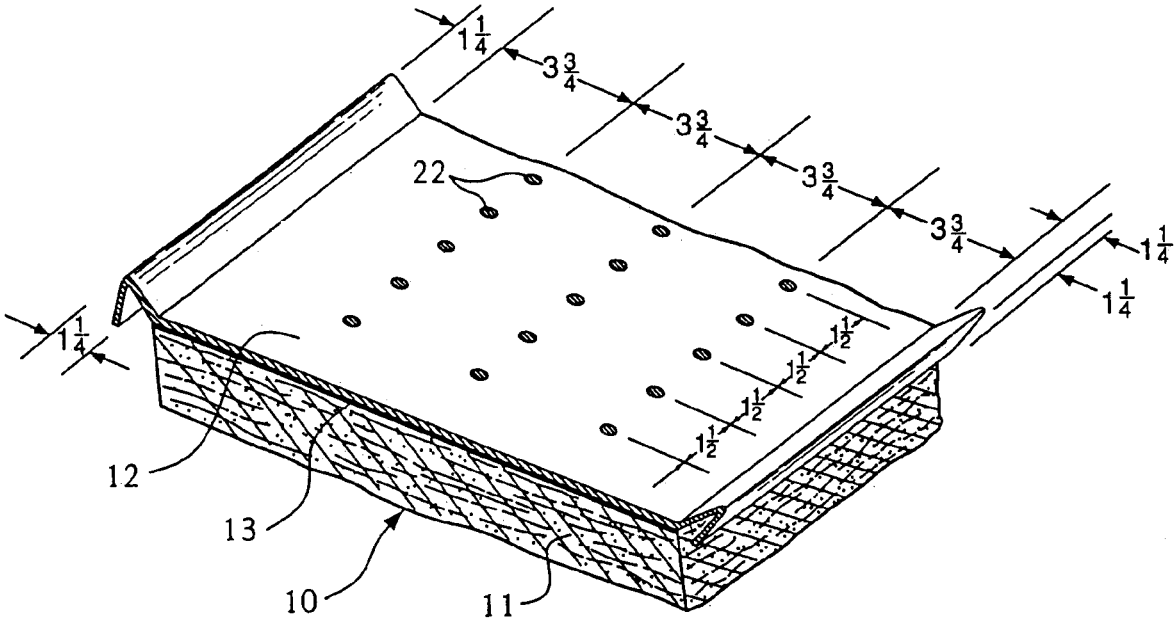
FIG. 2 is an illustration similar to that of FIG. 1, but with different grid spacing for the spots of adhesive that are visible through the perforations.

In FIG. 2, the blanket 10 of insulation is constructed similarly, except for the pattern of the grid formed by the spots 22. Here, the spots 22 are arranged in vertical lines that are 3¾ inches apart, as shown, with the spots 22 also being typically spaced apart vertically, forming horizontal lines 1½ inches apart. The fastener edges or tabs in the embodiment of FIG. 2 are sized and arranged in the same manner as set forth above for FIG. 1.

Figure 3:
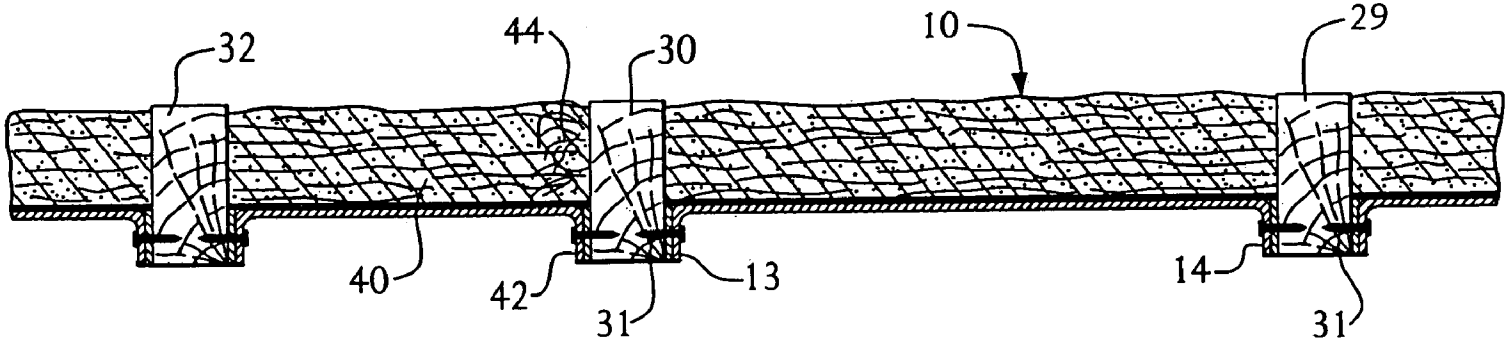
FIG. 3 is a horizontal sectional view, taken through a plurality of vertically spaced-apart studs, between which blankets of insulation have been applied, wherein some of the studs have spacings therebetween that are different than the spacings between other studs.

Referring now to FIG. 3, it will be seen that the insulation blanket 10 is fastened between studs 30, with fastener edges 13, 14 being doubled over and nailed via suitable fasteners, staples, or the like 31 as shown.

However, at the left end of FIG. 3, it will be shown that the spacing between studs 30 and 32 is of a shorter dimension than that between the two studs 29, 30, because the blanket of insulation 40 disposed between the studs 30, 32, has been cut in a vertical line along a grid of spots, to correspond with the spacing between studs 30 and 32. In fact, because the cut line formed by the spots of adhesive may be used to simultaneously cut both the facing and the insulation layer, the insulation at the right side of the blanket 40 may be compressed, as at 41, such that a tab or edge 42 may be nailed or stapled to the stud 30, as seen in FIG. 3.

Figure 4:
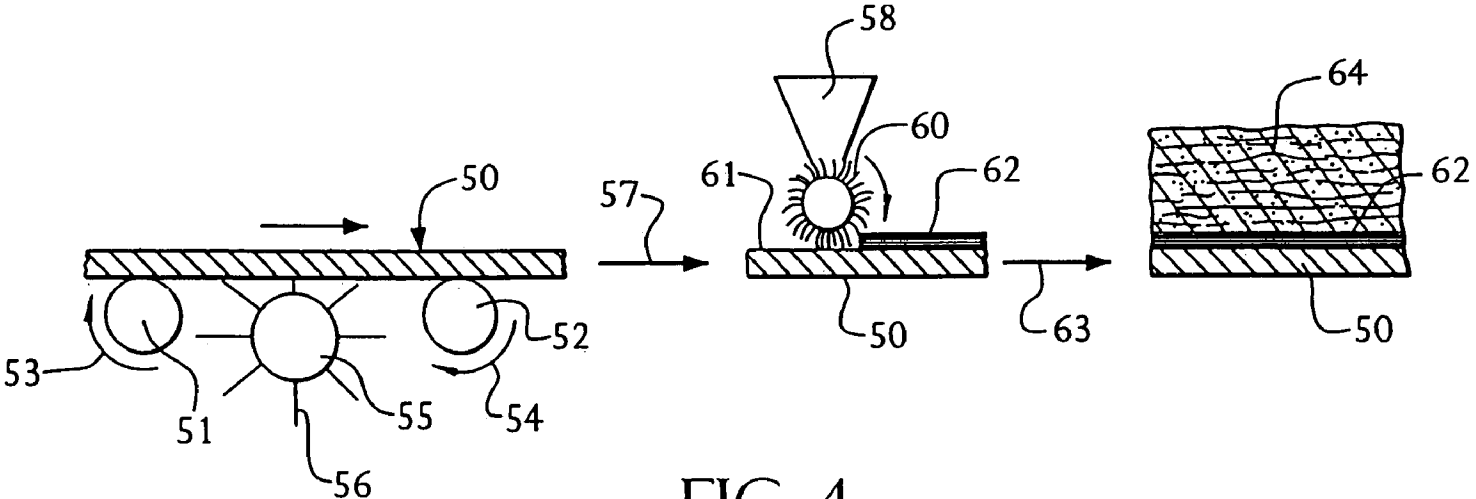
FIG. 4 is a schematic view of various steps for manufacturing a blanket of fibrous building insulation in accordance with this invention.

With reference now to FIG. 4, it will be seen that a facing material 50 may be made at a given location, as by passing along a conveyor comprised of rollers 51, 52, rotating in the clockwise direction shown by the arrows 53, 54, wherein a perforating roller 55, having a plurality of radialy directed spikes 56, spaced apart around the circumference of the roller 55, and spaced longitudinally along the roller (not shown), to yield a grid of perforations similar to that of FIG. 1 or FIG. 2, or in any other manner, such that facing material delivered from the site of facing material formation will already have the perforations therein. The facing material is then delivered to a site of blanket formation as schematically represented by the arrow 57.

At the center of the illustration of FIG. 4, there is schematically shown a site of adhesive application, wherein an adhesive is provided from a trough or the like 58, to be applied via a rotating brush 60 or the like, to a surface 61 of the facing material 50, to yield an adhesive layer 62 thereon. Then, the adhesive-applied facing layer 50 is delivered in the general direction for example of the arrow 63, to a location where the fibrous layer 64 is applied to the adhesive 62, whereby the facing layer 50 and the fibrous layer 64 are united together, upon setting of the adhesive layer 62.

As an alternative, the adhesive 62 can be applied by pre-coating the facing layer 60, rather than applying the adhesive at the site of application of the fiberglass layer to the facing layer.

It will thus be seen that a blanket formed in accordance with the process of FIG. 4 can be cut along the lines of a grid such as one of the grids illustrated in either of FIGS. 1 and 2, for installation of a cut blanket 40 between studs 30, 32, that are spaced apart non-standard amounts.

In accordance with this invention, it will be seen that no separate inking or printing step is required. The perforations allow the bleeding of adhesive to be visible from the opposite surface of the facing layer than that to which the adhesive is applied.

The roller or other means 55 that applies the perforations to the facing layer may make the perforations of a size that is best described as microperforations.

It has been reported that, in the manufacture of building structures, as many as 43% of the spacings between the vertically spaced-apart studs 30, 32, are of non-standard dimension. Accordingly, the present invention allows for adaptation of the blankets of fibrous building insulation material to such non-standard situations. It will also be apparent that the present invention is applicable to blankets of insulation of standard widths from side-to-side, other than 15 inches in width. For example, blankets of 24 inches in width, or of any other dimension lend themselves toward use of the present invention to provide cutting grids.

What is claimed is:

1. A blanket of fibrous building insulation for installation in openings between studs, beams, rafters or like spaced-apart structural members that are evenly spaced-apart as well as between structural members that are irregularly spaced-apart, with cutting guidelines for use in providing visual guidelines for cutting the blanket to size to accommodate irregular spaces between spaced-apart structural members, comprising:

(a) a fibrous insulation layer of a predetermined thickness having opposite first and second insulation surfaces between side surfaces that are spaced apart a given dimension, which first and second insulation surfaces define said predetermined thickness;

(b) a thin facing sheet having first and second sheet surfaces spaced apart a dimension that is substantially less than the predetermined thickness determined by the spacing apart of the insulation first and second surfaces, with the first sheet surface thereof disposed on a second insulation surface of the insulation layer;

(c) a thin adhesive layer, substantially thinner than the thickness of the insulation layer, disposed between and securing the first sheet surface of the facing sheet to the second insulation surface of the insulation layer;

(d) a grid of perforations through the facing sheet;

(e) spots of adhesive visible through the perforations, at the second sheet surface of the facing sheet;

(f) the grid of perforations comprising means defining generally straight, predetermined cut lines for cutting the facing sheet and insulation in accordance with a pattern defined by at least some of said spots of adhesive; whereby (g) the blanket of insulation may readily be cut along a line of said spots of adhesive to accommodate spaces between spaced-apart structural members of lesser spacing than said given dimension.

2. The blanket of fibrous building insulation of claim 1, wherein the insulation layer is of fiberglass construction.

3. The blanket of fibrous building insulation of claim 1, wherein the adhesive is asphalt.

4. The blanket of fibrous building insulation of claim 1, wherein the grid of perforations is of rectangular, intersecting horizontal and vertical lines of spaced-apart perforations.

5. The blanket of fibrous building insulation of claim 4, wherein the grid of perforations comprises four vertical, generally parallel spaced-apart cut lines, approximately 3 inches apart between side surfaces of said insulation layer.

6. The blanket of fibrous building insulation of claim 4, wherein the grid of perforations comprises three vertical, generally parallel spaced-apart cut lines, approximately 3¾ inches apart between side surfaces of said insulation layer.

7. The blanket of fibrous building insulation of any one of claims 5 and 6, wherein the grid of perforations comprises horizontal, generally parallel, spaced-apart cut lines, approximately 1½ inches apart.

8. A method of making a blanket of fibrous building insulation for use in openings between studs, between rafters, or between like spaced-apart structural members that are evenly spaced-apart as well as between such structural members that are irregularly spaced-apart, comprising the steps of:

(a) providing a thin layer of facing material for later application to a substantially thicker layer of fibrous insulation, with preformed perforations through the facing material in a defined, predetermined grid comprising cutting guidelines for use in providing visual guidelines for cutting the blanket to size to accommodate irregular spaces between spaced-apart structural members;

(b) delivering the facing material to a site of blanket formation;

(c) applying a thin layer of adhesive, that is substantially thinner than the layer of fibrous insulation, to a surface of the facing material while maintaining the adhesive at a sufficient viscosity that it will bleed into the perforations an amount sufficient to be visible from an opposite surface of the facing material;

(d) applying a layer of fibrous insulation, that is substantially thicker than any thickness of each of said layer of facing material and said layer of adhesive to the adhesive-applied surface of the facing material at the site of blanket formation; and (e) allowing the adhesive to set and adhere the facing material to the fibrous insulation layer.

9. A method of installing a blanket of fibrous building insulation comprising:

(a) making a blanket of fibrous building insulation in accordance with claim 8;

(b) cutting the blanket along a line of perforations to correspond the width of the blanket to a predetermined spacing between structural members between which a blanket of insulation is to be installed; and (c) fastening a portion of the cut blanket of fibrous building insulation in the predetermined spacing between structural members.

* * * * *